US007168168B2

(12) United States Patent
Hsieh

(10) Patent No.: US 7,168,168 B2
(45) Date of Patent: Jan. 30, 2007

(54) KNIFE PROTECTION DEVICE USED IN CUTTING DEVICE

(76) Inventor: Chih-Ching Hsieh, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/006,224

(22) Filed: Dec. 7, 2004

(65) Prior Publication Data

US 2006/0117571 A1 Jun. 8, 2006

(51) Int. Cl.
*B26B 13/06* (2006.01)

(52) U.S. Cl. ..... 30/252; 30/271

(58) Field of Classification Search ..... 30/120, 30/134, 250, 252, 254, 271
See application file for complete search history.

(56) References Cited

U.S. PATENT DOCUMENTS 419,489 A * 1/1890 Badger ..... 30/120
1,876,218 A * 9/1932 Gee ..... 30/134
2,105,332 A * 1/1938 Rauh ..... 30/271
2,798,291 A * 7/1957 Smith ..... 30/269
3,760,500 A * 9/1973 Eads et al. ..... 30/268
4,078,307 A * 3/1978 Zavala ..... 30/271
5,787,589 A * 8/1998 Auderset ..... 30/261
5,974,670 A * 11/1999 Hsieh ..... 30/252
6,334,255 B1 * 1/2002 Chang ..... 30/252

* cited by examiner

*Primary Examiner*—Hwei-Siu Payer

(57) ABSTRACT

A knife protection device used in a cutting device; the cutting device has a tool body; the tool body having a cutting section and a handle; the cutting section having at least one cutting portion. The knife protection device comprises a protection unit installed on the cutting section for preventing the cutting section to be expanded. The protection unit is a protection cover; and the protection cover is installed with a retaining portion and a knife protection portion. The tool body has a screwing portion; the screwing portion and the retaining portion have respective screw holes for retaining the protection unit to the tool body. The cutting portion has two knife edges; a clamping space is formed between one of the two knife edges and the knife protection portion; and another knife is capable of being receiving in the clamping space.

2 Claims, 9 Drawing Sheets

KNIFE PROTECTION DEVICE USED IN CUTTING DEVICE

FIELD OF THE INVENTION

The present invention relates to knife protection devices, and in particular to a knife protection device used in a cutting device, wherein when a cutting device is used to cut an object, the present invention has the advantage of preventing the knife edges of the cutting device from being destroyed so as to have a longer lifetime.

BACKGROUND OF THE INVENTION

In the prior art cutting device, protecting covers are used to enclose the knife portions so as to prevent the knife edges to be destroyed. However generally, the damage of the knife portions of a cutting means is due to the use of the cutting means (at this moment, the cover is taken out from the cutting device and thus no protection function is presented).

In use of a cutting means, if a great force is applied to the device, the knife portions will suffer the great force so as to wear or be damaged. However this will reduce the lifetime of the cutting device.

This is because in cutting, the two knife edges of the cutting device will resist against an object to be cut so that the great force will apply to the contact surfaces of the two knife edges. However for a longer time the contact surfaces will wear. Furthermore, this will induce the knife edges to shift from one another so that they can not be aligned in cutting. However this will induce that the object to be cut cannot be cut effectively.

SUMMARY OF THE INVENTION

Accordingly, the primary object of the present invention is to provide a knife protection device used in a cutting device, wherein when a cutting device is used to cut an object, the present invention has the advantage of preventing the knife edges of the cutting device to be destroyed so as to have a longer life time.

To achieve above object, the present invention provides a knife protection device used in a cutting device. The cutting device has a tool body; the tool body having a cutting section and a handle; the cutting section having at least one cutting portion. The knife protection device comprises a protection unit installed on the cutting section. The protection unit is a protection cover; and the protection cover is installed with a retaining portion and a knife protection portion. The tool body has a screwing portion; the screwing portion and the retaining portion have respective screw holes for retaining the protection unit to the tool body. The cutting portion has two knife edges; a clamping space is formed between one of the two knife edges and the knife protection portion; and another knife is capable of being receiving in the clamping space.

Furthermore, the present invention provide a knife protection device used in a cutting device; the cutting device being a pliers; a retaining portion being installed below a pivotal portion of the pliers; a protection unit being secured to be near a first knife edge for preventing the first knife edge to resist against a second knife edge. The protection unit is a protection cover; and the protection cover is installed with a retaining portion; a body of the pliers has a screwing portion; the screwing portion and the retaining portion have respective screw holes for retaining the protection unit to the body.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
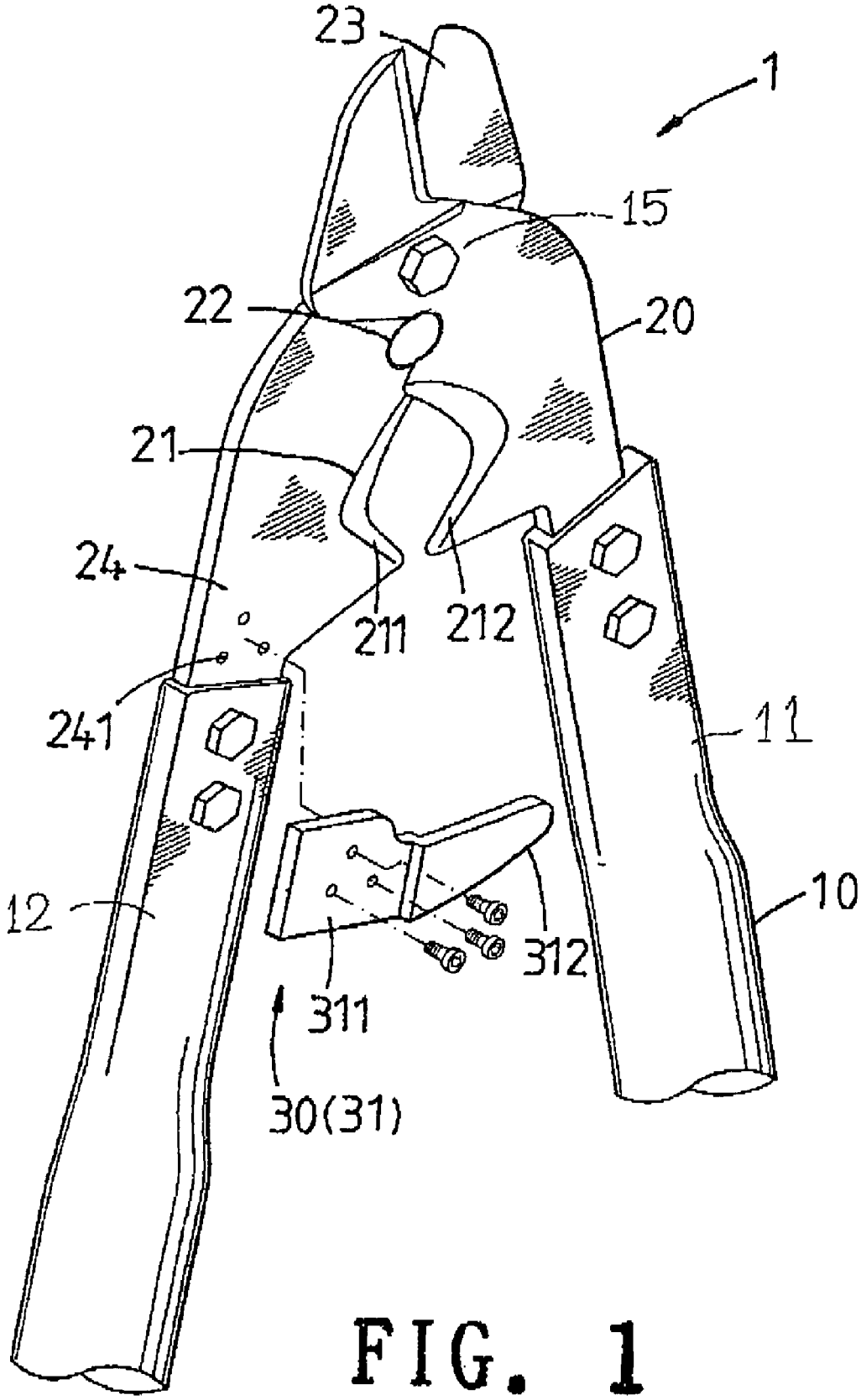
FIG. 1 is an exploded perspective view of the present invention.

With reference to FIG. 1, the present invention includes the following elements.

A tool body 1 has a handle 10 and a cutting section 20.

The cutting section 20 has at least one cutting portion and a protection unit 30. In this embodiment, the cutting section 20 has a first cutting portion 21, a second cutting portion 22 above the first cutting portion 21 and a third cutting portion 23 above the second cutting portion 22. Each of the first cutting portion 21, second cutting portion 22 and third cutting portion 23 has two knife edges. The first, second and third cutting portion are spaced apart and the second and third cutting portions 22, 23 are spaced by a pivotal portion 15. The first cutting portion 21 has a first knife edge 211 and a second knife edge 212.

The protection unit 30 is installed to a portion of the cutting section 20 near the first knife edge 211. The cutting section 20 has a screwing portion 24. The screwing portion 24 has a plurality of first screw holes 241 for retaining the protection unit 30. The protection unit 30 is a protection cover 31 which is formed by a retaining portion 311 and a knife protection portion 312. The handle 10 has a left leg 12 and a right leg 11. When the right leg 11 and left leg 12 move closely, the knife protection portion 312 will contact an inner side of one of the two legs 11, 12. The retaining portion 311 has a plurality of second screw holes so as to fix the retaining portion 311 to the screw holes 241.

Figure 2:
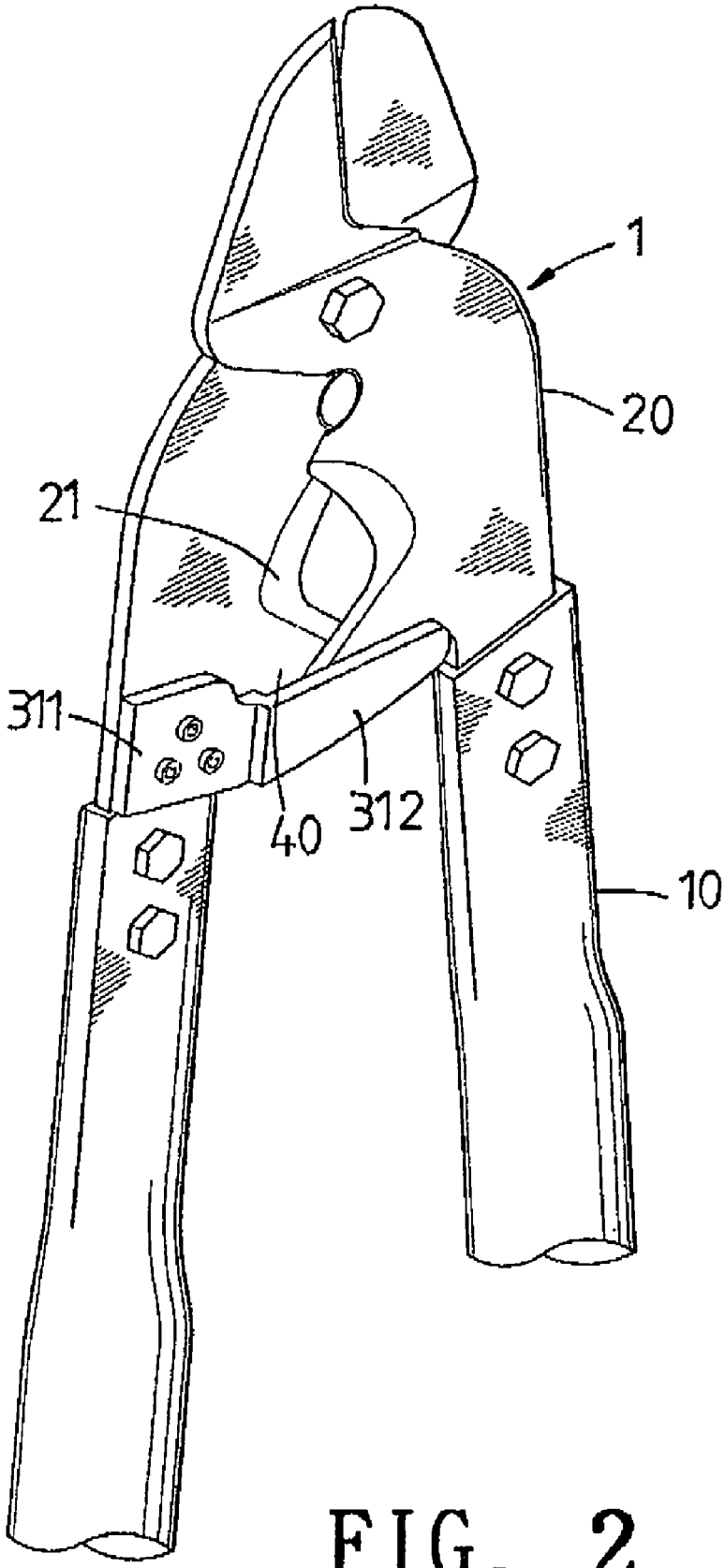
FIG. 2 is an assembled view of the present invention.

Referring to FIG. 2, after assembly, a clamping space 40 is a gap formed between the first cutting portion 21 and the knife protection portion 312. In cutting, the clamp space 40 serves for receiving the second knife edge 212 so as to have the function of the protection.

Figure 3:
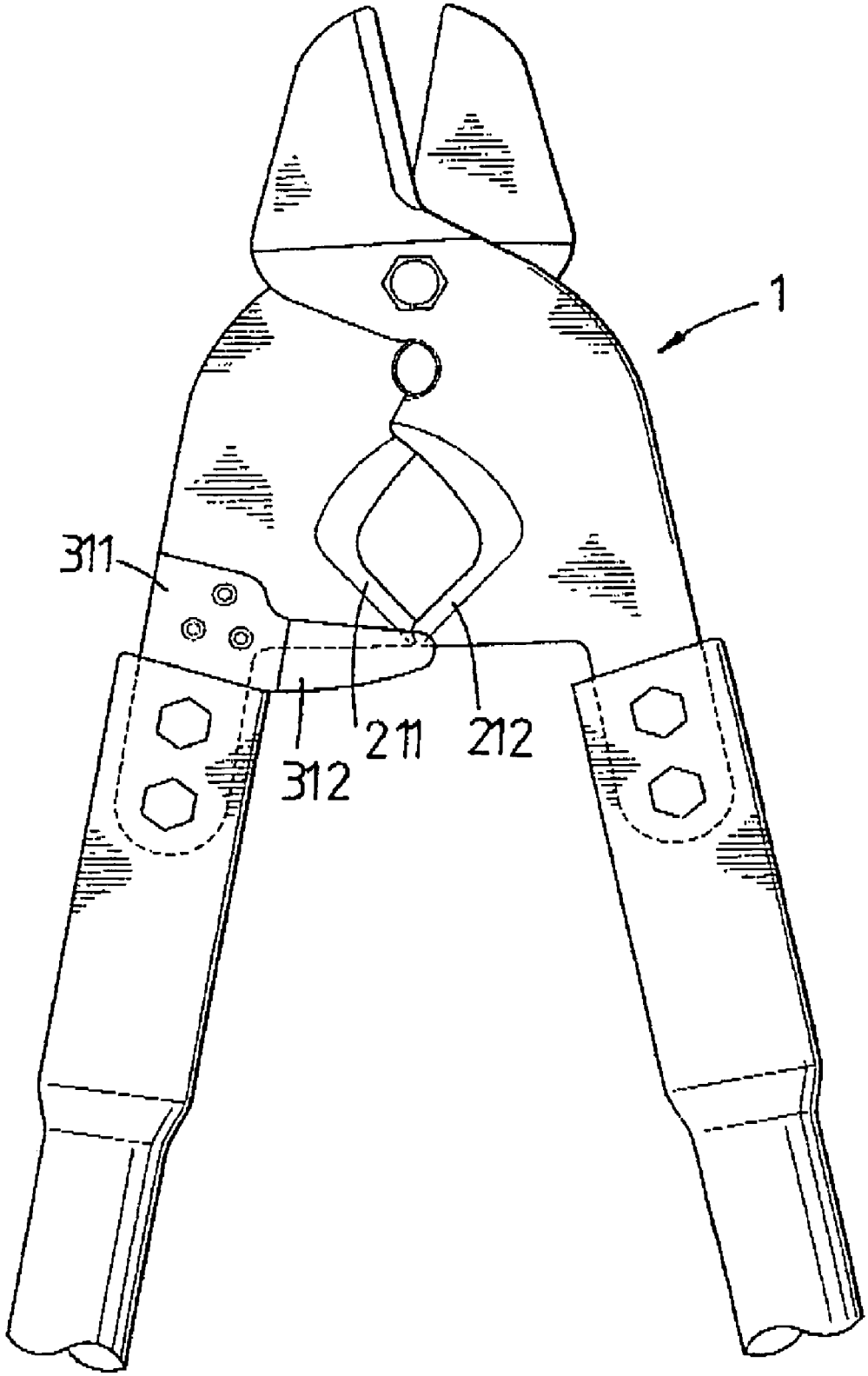
FIG. 3 shows one application of the present invention.
Figure 4:
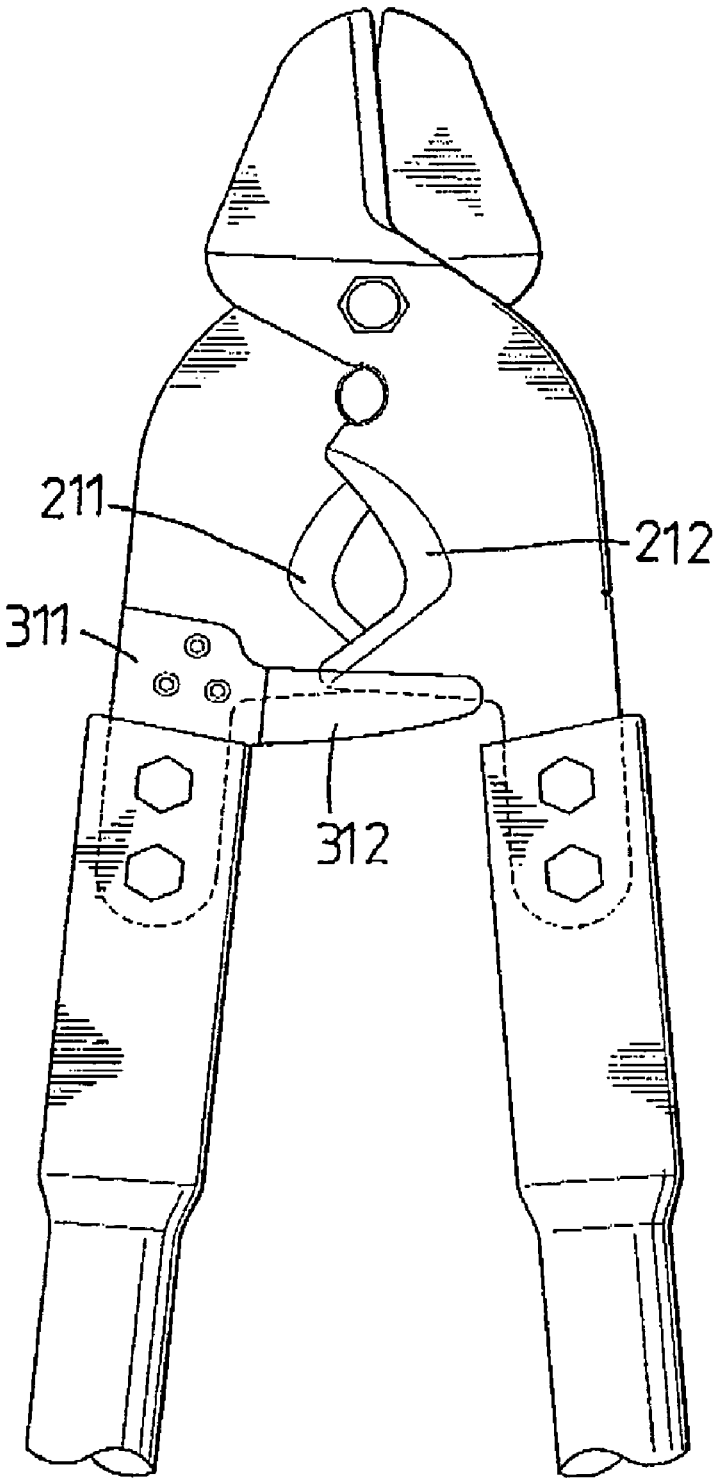
FIG. 4 shows another application of the present invention.

Referring to FIGS. 3 and 4, in use of the present invention, initially, when the second knife edge 212 is in contact with the first knife edge 211, the second knife edge 212 is in a protection range of the first knife edge 211 and in the clamping space 40. Then the larger the contact surface with the knife protection portion 312, the greater the protection space. Thereby it is difficult to expand the cutting section 20.

When a great force is applied to the cutting section 20, the first knife edge 211 is more closer to the second knife edge 212. As a result the contact area between the second knife edge 212 and the knife protection portion 312 are greater so that the stress force is dispersed to be more uniformly distributed on the cutting section 20. Thereby the cutting section 20 is protected from destroy in cutting operation.

Figure 5:
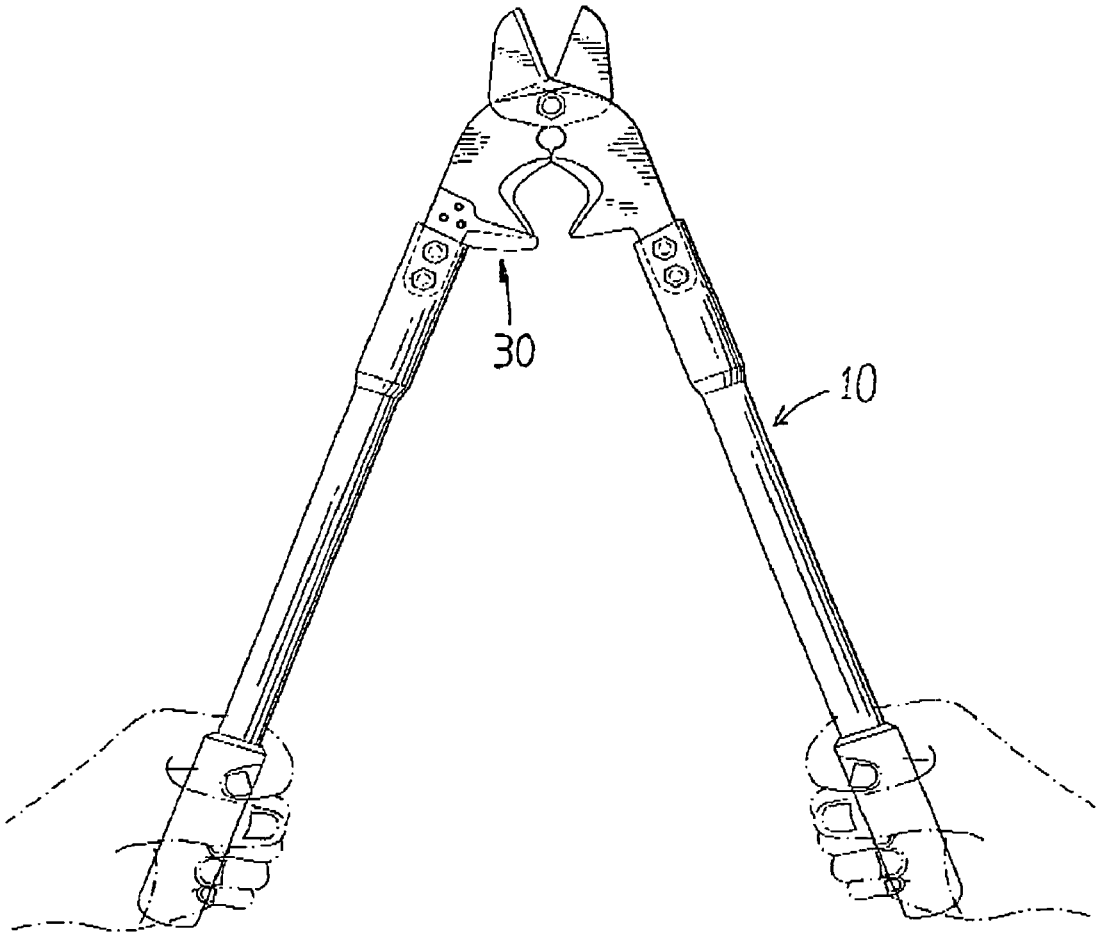
FIG. 5 shows the use of the present invention.
Figure 6:
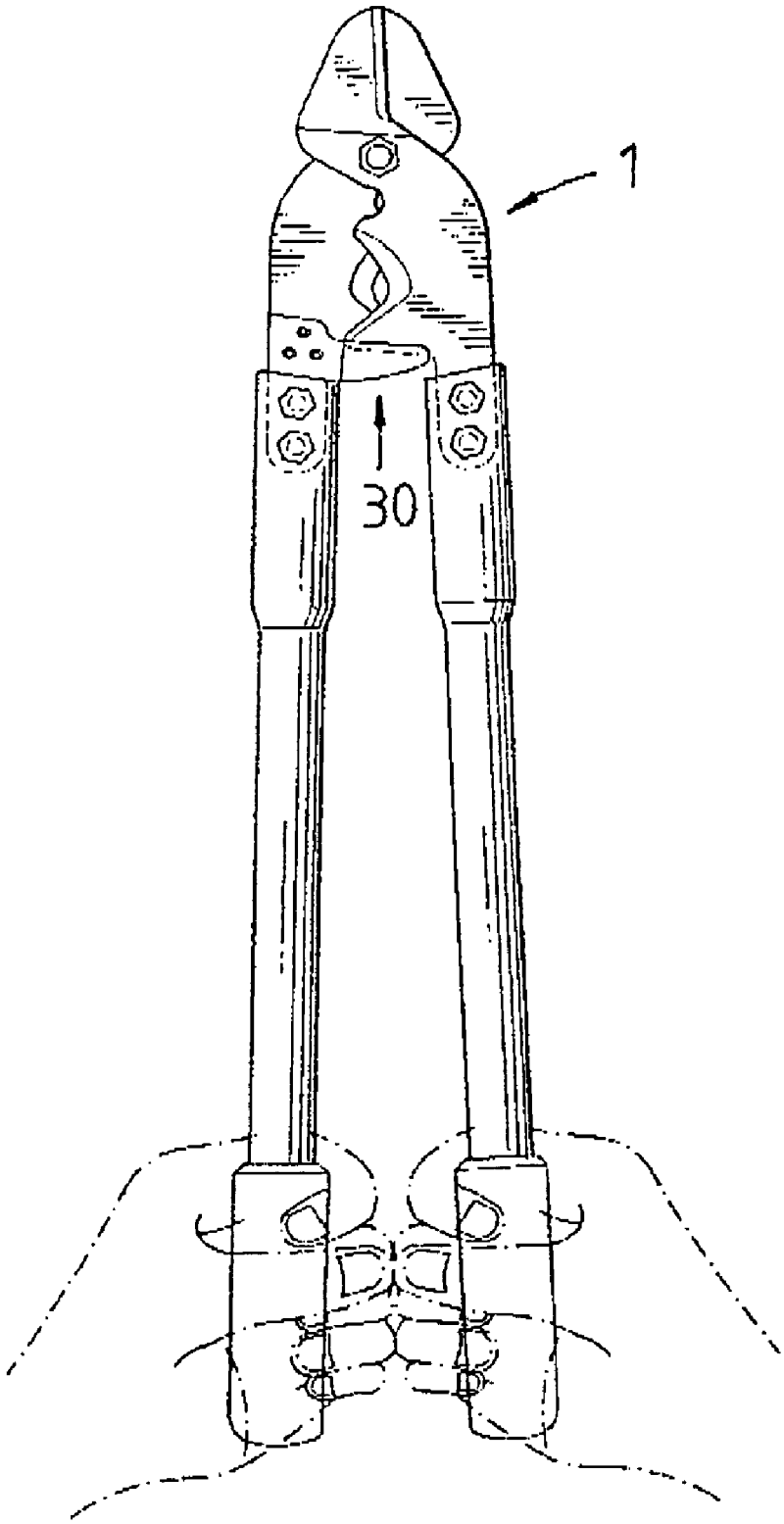
FIG. 6 is a schematic view about another use of the present invention.

Referring to FIGS. 5 and 6, applications of the present invention is illustrated. It is illustrated that the present invention can be used to a tool body 1 for cutting a steel cable, a steel plate, or a steel rope. The tool body 1 has a longer handle 10 so as to suffer from a greater force. However in use, these tools suffer from greater forces and thus it is eager to have the protection unit of the present invention to protect the cutting section so as to have a longer lifetime.

Figure 7:
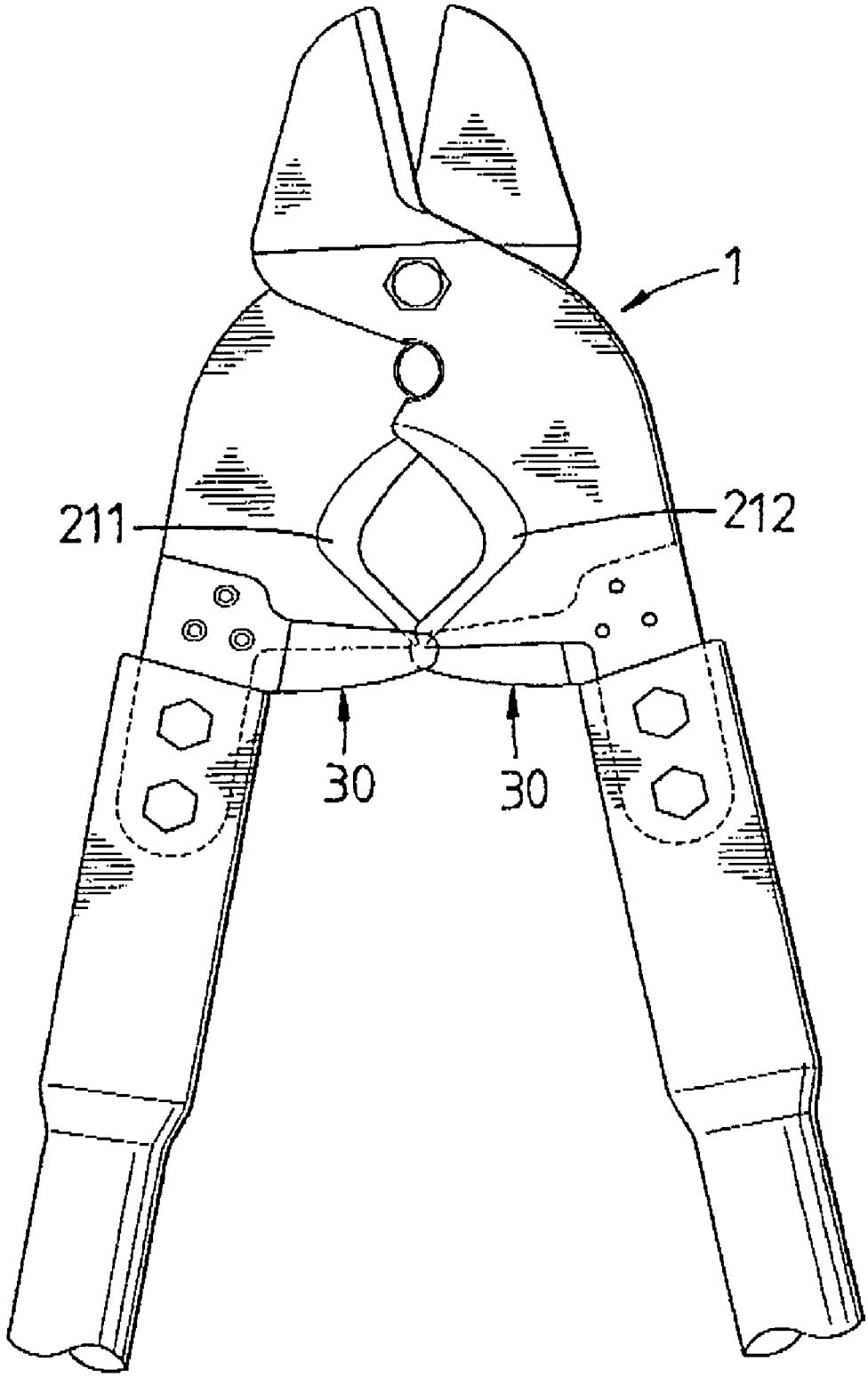
FIG. 7 shows another embodiment of the present invention.

With reference to FIG. 7, one side of the second knife edge 212 has a further protection unit 30 same as that in the first knife edge 211 so as to have the function of dual protections.

Figure 8:
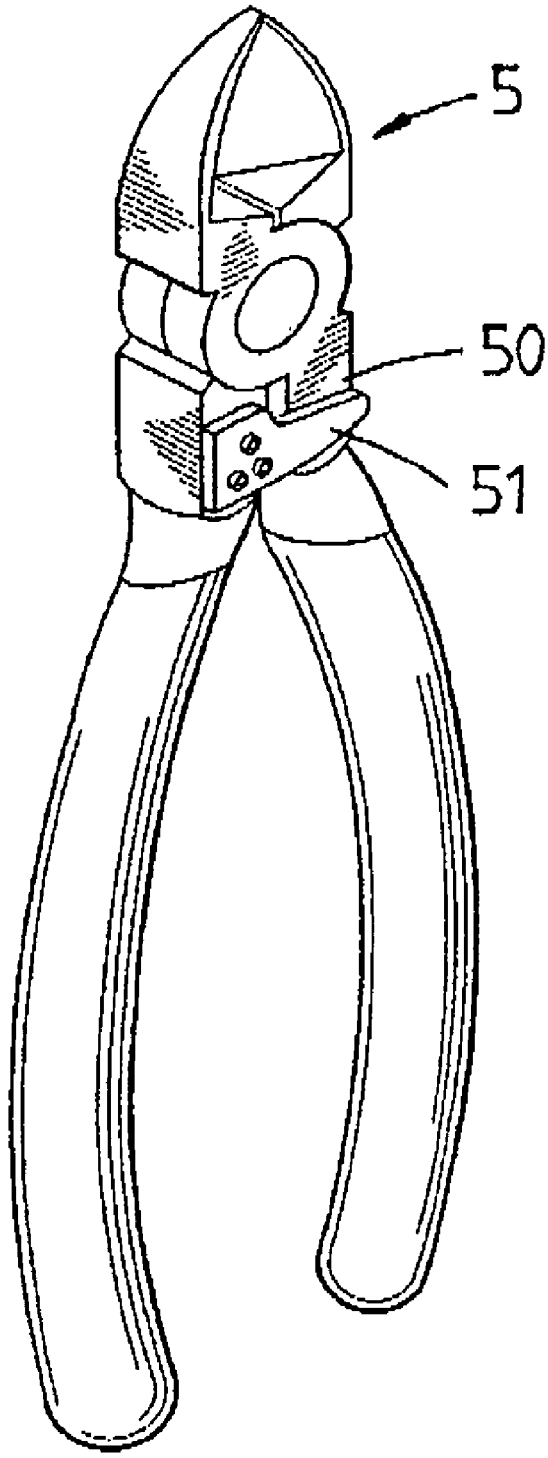
FIG. 8 is a schematic view about the third embodiment of the present invention.
Figure 9:
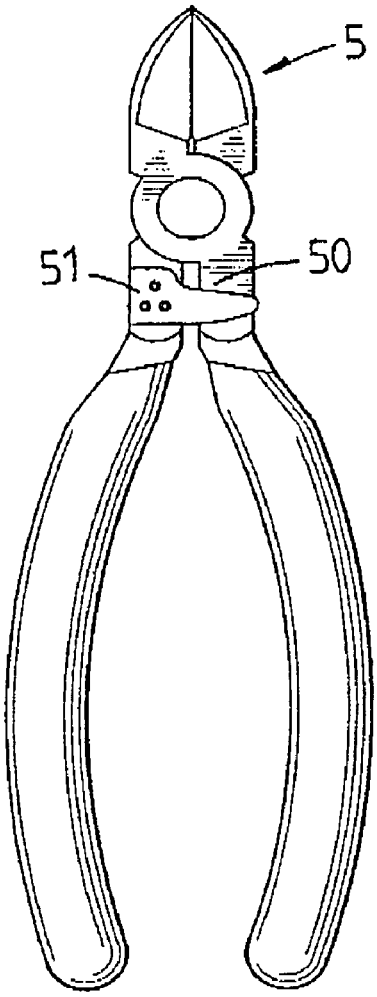
FIG. 9 is another schematic view about the third embodiment of the present invention.
Figure 10:
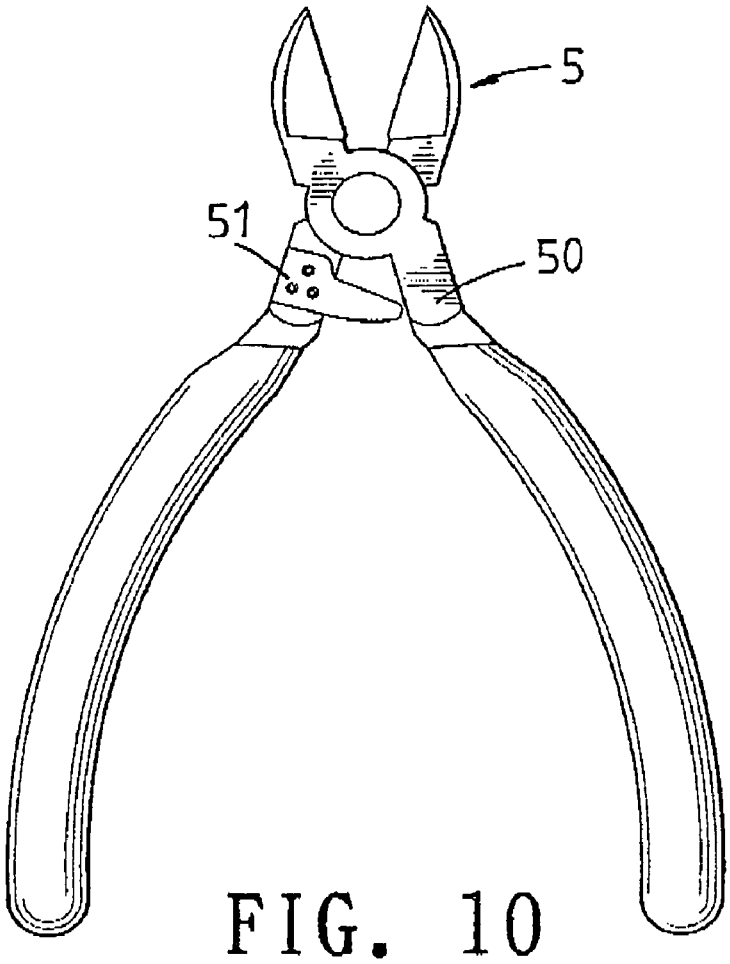
FIG. 10 is a further schematic view about the third embodiment of the present invention, where the structure is in an open position.

Referring to FIGS. 8 to 10, the present invention can be used to pliers 5. The pliers have a resisting portion 50 below a pivotal portion. In operation, when the two knife edges of the pliers are move to an extreme position, the two knife edges will contact with one another. The protection unit 51 is installed at one side of the resisting portion 50 so as to prevent the two edges to move more closer to deform.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A cutting device with a knife protection device; the cutting device comprising:

a tool body (1); the tool body having a cutting section and a handle; the cutting section having three cutting portions; and the handle having a right leg and a left leg;

a knife protection device comprising:

a protection unit installed on the cutting section;

wherein the protection unit is a protection cover; and the protection cover has a retaining portion and a knife protection portion;

wherein the tool body has a screwing portion; the screwing portion and the retaining portion have respective screw holes for retaining the protection unit to the tool body;

wherein there are three cutting portions, a first cutting portion near the handle, a second cutting portion above the first cutting portion, and a third cutting portion above the second cutting portion, and the first, second and third cutting portions are spaced apart and the second and third cutting portions are spaced by a pivotal portion; the first cutting portion near the handle has two knife edges; a clamping space is formed between one of the two knife edges and the knife protection portion; and the other knife edge is capable of being received in the clamping space;

wherein when the right leg and left leg move closely, the knife protection portion will contact an inner side of one of the two legs; and wherein the two knife edges are a first knife edge and a second knife edge; the protection unit is secured to be near the first knife edge.

2. The cutting device with the knife protection device as claimed in claim 1, wherein a further protection unit is secured to the second knife edge.

* * * * *